US009766567B2

(12) United States Patent
Tasaki et al.

(10) Patent No.: US 9,766,567 B2
(45) Date of Patent: Sep. 19, 2017

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Mona Tasaki, Kanagawa (JP); Fusako Kiyono, Kanagawa (JP); Yutaka Saito, Kanagawa (JP); Hiroki Ohmori, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/211,637

(22) Filed: Jul. 15, 2016

(65) Prior Publication Data

US 2017/0199478 A1 Jul. 13, 2017

(30) Foreign Application Priority Data

Jan. 13, 2016 (JP) ..... 2016-004649

(51) Int. Cl.

| | |
|---|---|
| ***G03G 9/097*** | (2006.01) |
| ***G03G 15/08*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/09791* (2013.01); *G03G 9/0819* (2013.01); *G03G 9/0827* (2013.01); *G03G 9/08755* (2013.01); *G03G 9/0904* (2013.01); *G03G 15/0865* (2013.01)

(58) Field of Classification Search

CPC ..... G03G 9/09791

See application file for complete search history.

(56) References Cited

U.S. PATENT DOCUMENTS

2010/0330482 A1 12/2010 Okita et al.

FOREIGN PATENT DOCUMENTS

| | | | | |
|---|---|---|---|---|
| JP | 63-073269 | * | 4/1988 | ..... G03G 9/08 |
| JP | 2005-202114 A | | 7/2005 | |
| JP | 2011-008129 A | | 1/2011 | |
| JP | 2011-242732 A | | 12/2011 | |

OTHER PUBLICATIONS

Translation of JP 63-073269 published Apr. 1988.*

* cited by examiner

*Primary Examiner* — Peter Vajda

(74) *Attorney, Agent, or Firm* — Oliff PLC

(57) ABSTRACT

An electrostatic-image developing toner contains toner particles and particles of a metallic salt of a fatty acid deposited on the toner particles. The particles of the metallic salt of the fatty acid contain 0.0008% to 0.01% by mass of iron.

20 Claims, 2 Drawing Sheets

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2016-004649 filed Jan. 13, 2016.

BACKGROUND (i) Technical Field

The present invention relates to electrostatic-image developing toners, electrostatic image developers, and toner cartridges.

(ii) Related Art

There is a method for forming an image by transferring a toner image from an image carrier to an intermediate transfer member and then transferring the toner image from the intermediate transfer member to a recording medium. If a blade is disposed in contact with the intermediate transfer member to remove residual toner and other contaminants from the intermediate transfer member, lateral streaks may appear in images formed on recording media after repeated image-forming operations.

SUMMARY

According to an aspect of the invention, there is provided an electrostatic-image developing toner containing toner particles and particles of a metallic salt of a fatty acid deposited on the toner particles. The particles of the metallic salt of the fatty acid contain 0.0008% to 0.01% by mass of iron.

BRIEF DESCRIPTION OF THE DRAWINGS

Exemplary embodiments of the present invention will be described in detail based on the following figures, wherein.

DETAILED DESCRIPTION

Figure 1:
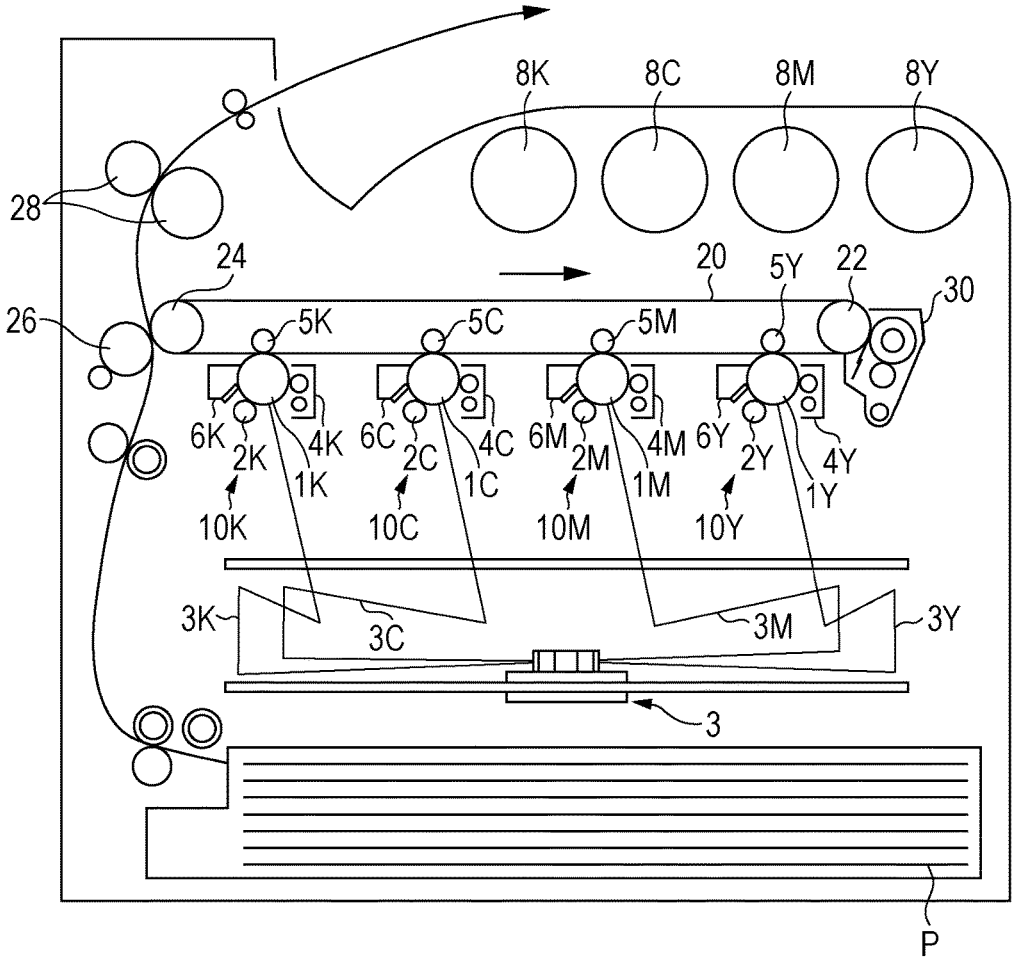
FIG. 1 is a schematic view of an example image-forming apparatus according to an exemplary embodiment.

Exemplary embodiments and examples of the present invention will now be described. The following exemplary embodiments and examples are for illustration purposes only and are not intended to limit the scope of the invention.

As used herein, electrostatic-image developing toners are also simply referred to as "toner", and electrostatic image developers are also simply referred to as "developer".

As used herein, the term "lateral streak" refers to an unintentional streak-like or strip-like image that appears in an image formed on a recording medium and that extends perpendicular to the transport direction of the recording medium.

Electrostatic-Image Developing Toner

An electrostatic-image developing toner according to an exemplary embodiment contains toner particles and particles of a metallic salt of a fatty acid deposited on the toner particles. The particles of the metallic salt of the fatty acid contain 0.0008% to 0.01% by mass of iron.

It is known to use particles of a metallic salt of a fatty acid, such as zinc stearate, as an external additive in a toner. The particles of the metallic salt of the fatty acid are liberated from the toner particles and function as a lubricant between an image carrier and a blade for cleaning the image carrier. Some of these particles are also transferred from the image carrier to an intermediate transfer member and function as a lubricant between the intermediate transfer member and a blade for cleaning the intermediate transfer member (hereinafter referred to as "intermediate-transfer-member cleaning blade").

However, lateral streaks may appear in images formed on recording media after repeated image-forming operations. The lateral streaks appear when the toner particles, including the external additive, pass through the contact area (blade nip) between the intermediate transfer member and the intermediate-transfer-member cleaning blade. A possible mechanism is described below.

Of the toner particles transferred from the image carrier to the intermediate transfer member, those remaining on the intermediate transfer member without being transferred to a recording medium are accumulated at the blade nip and are collected into a cleaning device. The amount of particles of the metallic salt of the fatty acid accumulated at the blade nip decreases with decreasing amount of particles of the metallic salt of the fatty acid transferred from the image carrier to the intermediate transfer member and with increasing amount of particles of the metallic salt of the fatty acid transferred from the intermediate transfer member to a recording medium. In this case, the blade may deflect or hop because of the insufficient lubrication of the particles of the metallic salt of the fatty acid and may thus allow the toner particles accumulated at the blade nip to pass through the blade nip after repeated image-forming operations. Conversely, the amount of particles of the metallic salt of the fatty acid accumulated at the blade nip increases with increasing amount of particles of the metallic salt of the fatty acid transferred from the image carrier to the intermediate transfer member and with decreasing amount of particles of the metallic salt of the fatty acid transferred from the intermediate transfer member to a recording medium. In this case, the toner particles, including the particles of the metallic salt of the fatty acid, may pass through the blade nip when the amount of toner particles accumulated at the blade nip exceeds the capacity of the blade nip after repeated image-forming operations.

That is, lateral streaks appear possibly because the toner particles pass through the blade nip when the particles of the metallic salt of the fatty acid are present in relatively large or small amounts on the intermediate transfer member.

In contrast, the electrostatic-image developing toner according to this exemplary embodiment may leave few or no lateral streaks since the particles of the metallic salt of the fatty acid deposited on the toner particles contain 0.0008% to 0.01% by mass or more of iron. Whereas particles of metallic salts of fatty acids tend to be positively charged by friction in a developing unit because of their constituents, the particles of the metallic salt of the fatty acid according to this exemplary embodiment are less positively charged and are nearly electrically neutral since they contain 0.0008% by mass or more of iron. The particles of the metallic salt of the fatty acid according to this exemplary embodiment, however, are not completely electrically neutral since the iron content is 0.01% by mass or less. Such charging characteristics may allow the particles of the metallic salt of the fatty acid to be transferred in moderate amounts from the image carrier to the intermediate transfer member and from the intermediate transfer member to a recording medium, so that the toner particles may be less likely to pass through the blade nip. This may result in few or no leave lateral streaks after repeated image-forming operations.

The electrostatic-image developing toner according to this exemplary embodiment, will now be described in detail.

Particles of Metallic Salt of Fatty Acid

In this exemplary embodiment, iron is present in the particles of the metallic salt of the fatty acid deposited on the toner particles in an amount of 0.0008% to 0.01% of the total mass of the particles of the metallic salt of the fatty acid. To reduce lateral streaks, the iron content of the particles of the metallic salt of the fatty acid is adjusted to 0.0008% by mass or more, preferably 0.001% by mass or more, more preferably 0.002% by mass or more, even more preferably 0.003% by mass or more. The iron content of the particles of the metallic salt of the fatty acid is also adjusted to 0.01% by mass or less, preferably 0.009% by mass or less, more preferably 0.008% by mass or less, even more preferably 0.007% by mass or less, still more preferably 0.006% by mass or less.

To further reduce lateral streaks, the molar ratio of iron atoms to metallic atoms other than iron atoms present in the particles of the metallic salt of the fatty acid (number of moles of iron atoms/number of moles of metallic atoms other than iron atoms) may be adjusted to $1\times10^{-4}$ to $1\times10^{-3}$.

For example, iron may be incorporated into the particles of the metallic salt of the fatty acid by adding an iron-containing compound during the manufacture the metallic salt of the fatty acid (e.g., saponification) or during the pulverization of a solid of the metallic salt of the fatty acid into particles. The iron content of the particles of the metallic salt of the fatty acid may be controlled by adjusting the amount of iron-containing compound added.

Examples of iron-containing compounds that may be used to incorporate iron into the particles of the metallic salt of the fatty acid include iron salts of fatty acids (e.g., iron butyrate, iron valerate, iron stearate, iron laurate, iron linoleate, iron oleate, iron palmitate, iron myristate, iron caprylate, iron caproate, iron margarate, iron arachidate, and iron behenate), iron nitrate, iron sulfate, iron hydroxide, iron phosphate, iron oxide, iron chloride, iron bromide, and iron sulfide.

Examples of metals that may form the metallic salt of the fatty acid present in the particles of the metallic salt of the fatty acid include zinc, calcium, magnesium, barium, aluminum, lithium, and potassium, preferably zinc, calcium, and magnesium.

Examples of fatty acids that may form the metallic salt of the fatty acid present in the particles of the metallic salt of the fatty acid include saturated and unsaturated fatty acids such as butyric acid, valeric acid, stearic acid, lauric acid, linoleic acid, oleic acid, palmitic acid, myristic acid, caprylic acid, caproic acid, margaric acid, arachidic acid, and behenic acid.

For reasons of lubrication performance, compound stability, and availability, a metallic salt of stearic acid or lauric acid may be used as the metallic salt of the fatty acid present in the particles of the metallic salt of the fatty acid.

Examples of metallic salts of stearic acid that may be present in the particles of the metallic salt of the fatty acid include zinc stearate, calcium stearate, magnesium stearate, barium stearate, aluminum stearate, lithium stearate, and potassium stearate.

Examples of metallic salts of lauric acid that may be present in the particles of the metallic salt of the fatty acid include zinc laurate, calcium laurate, magnesium laurate, barium laurate, aluminum laurate, lithium laurate, and potassium laurate.

For reasons of lubrication performance, compound stability, and availability, zinc stearate may be used as the metallic salt of the fatty acid present in the particles of the metallic salt of the fatty acid.

The particles of the metallic salt of the fatty acid preferably have a volume average particle size of 0.1 to 10 μm, more preferably 0.5 to 3 μm.

The particles of the metallic salt of the fatty acid are preferably present in an amount of 0.005 to 1 part by mass, more preferably 0.01 to 0.5 part by mass, even more preferably 0.02 to 0.5 part by mass, still more preferably 0.02 to 0.3 part by mass, per 100 parts by mass of the toner particles.

Toner Particles

For example, the toner particles contain a binder resin and optionally contain a colorant, a release agent, and other additives.

Binder Resin

Examples of binder resins include vinyl resins made of homopolymers or copolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Other examples of binder resins include non-vinyl resins such as epoxy resins, polyester resins, polyurethane resins, polyamide resins, cellulose resins, polyether resins, and modified rosins; mixtures thereof with vinyl resins; and graft copolymers thereof with vinyl monomers.

These binder resins may be used alone or in combination.

The binder resin may be a polyester resin. Examples of polyester resins include condensation polymers of polycarboxylic acids with polyhydric alcohols.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower (e.g., $C_1$-$C_5$) alkyl esters thereof. Preferred polycarboxylic acids include aromatic dicarboxylic acids.

These dicarboxylic acids may be used in combination with carboxylic acids having a functionality of 3 or more (e.g., crosslinked or branched). Examples of carboxylic acids having a functionality of 3 or more include trimellitic acid, pyromellitic acid, and anhydrides and lower (e.g., $C_1$-$C_5$) alkyl esters thereof.

These polycarboxylic acids may be used alone or in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Preferred polyhydric alcohols include aromatic diols and alicyclic diols, more preferably aromatic diols.

These diols may be used in combination with polyhydric alcohols having a functionality of 3 or more (e.g., cross-linked or branched). Examples of polyhydric alcohols having a functionality of 3 or more include glycerol, trimethylolpropane, and pentaerythritol.

These polyhydric alcohols may be used alone or in combination.

The polyester resin preferably has a glass transition temperature (Tg) of 50° C. to 80° C., more preferably 50° C. to 65° C.

The glass transition temperature may be determined from a differential scanning calorimetry (DSC) curve. Specifically, the glass transition temperature (Tg) may be determined as the extrapolated glass transition onset temperature defined in the "Determination of Glass Transition Temperature" section of JIS K 7121-1987 (Testing Methods for Transition Temperatures of Plastics).

The polyester resin preferably has a weight average molecular weight (Mw) of 5,000 to 1,000,000, more preferably 7,000 to 500,000. The polyester resin may have a number average molecular weight (Mn) of 2,000 to 100,000. The polyester resin preferably has a molecular weight distribution Mw/Mn of 1.5 to 100, more preferably 2 to 60.

The weight average molecular weight and the number average molecular weight may be determined by gel permeation chromatography (GPC). Specifically, GPC measurements may be obtained by a Tosoh HLC-8120 GPC system equipped with a Tosoh TSKgel Super HM-M column (15 cm) using tetrahydrofuran (THF) as an eluent. These measurements may be compared with a molecular weight calibration curve obtained from monodisperse polystyrene standards to calculate the weight average molecular weight and the number average molecular weight.

The polyester resin may be prepared by known processes. For example, the polyester resin may be prepared by performing a polycondensation reaction at 180° C. to 230° C., optionally under reduced pressure to remove water and alcohol produced by condensation.

If the starting monomers are insoluble or incompatible with each other at the reaction temperature, they may be dissolved by adding a high-boiling-point solvent serving as a solubilizer. In this case, the polycondensation reaction may be performed while the solubilizer is distilled off. If a copolymerization reaction is performed in the presence of a poorly compatible monomer, the poorly compatible monomer may be condensed with the acid or alcohol to be polycondensed therewith before polycondensation with the remaining components.

The binder resin is preferably present in an amount of, for example, 40% to 95%, more preferably 50% to 90%, even more preferably 60% to 85%, of the total mass of the toner particles.

Colorant

Examples of colorants include pigments such as carbon black, chrome yellow, hansa yellow, benzidine yellow, threne yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

Optionally, the colorant may be surface-treated or used in combination with dispersants. More than one colorant may be used in combination.

The colorant is preferably present in an amount of, for example, 1% to 30%, more preferably 3% to 15%, of the total mass of the toner particles.

Release Agent

Non-limiting examples of release agents include hydrocarbon waxes; natural waxes such as carnauba wax, rice wax, and candelilla wax; synthetic, mineral, and petroleum waxes such as montan wax; and ester waxes such as fatty acid esters and montanic acid esters.

The release agent preferably has a melting temperature of 50° C. to 110° C., more preferably 60° C. to 100° C.

The melting temperature may be determined from a DSC curve as the melting peak temperature defined in the "Determination of Melting Temperature" section of JIS K 7121-1987 (Testing Methods for Transition Temperatures of Plastics).

The release agent is preferably present in an amount of, for example, 1% to 20%, more preferably 5% to 15%, of the total mass of the toner particles.

Other Additives

Examples of other additives include known additives such as magnetic materials, charge control agents, and inorganic powders. These additives are present as internal additives in the toner particles.

Properties of Toner Particles

The toner particles may be single-layer toner particles or core-shell toner particles including a core (core particle) and a coating (shell layer) covering the core. The core-shell toner particles may include, for example, a core containing a binder resin and other optional additives, such as colorants and release agents, and a coating containing a binder resin.

The toner particles preferably have a volume average particle size (D50v) of 2 to 10 μm, more preferably 4 to 8 μm.

Various average particle sizes and particle size distribution indices of the toner particles may be determined by a Coulter Multisizer II (Beckman Coulter, Inc.) using Isoton-II (Beckman Coulter, Inc.) as an electrolyte.

A measurement is performed as follows. To 2 mL of a 5% by mass aqueous solution of a surfactant (e.g., sodium alkylbenzenesulfonate), serving as a dispersant, is added 0.5 to 50 mg of a test sample. The mixture is added to 100 to 150 mL of the electrolyte.

The sample is dispersed in the electrolyte using a sonicator for 1 minute. Volume- and number-based particle size distributions of particles having particle sizes of 2 to 60 μm are obtained by a Coulter Multisizer II with a 100 μm aperture. A total of 50,000 particles are sampled.

Based on the resulting particle size distributions, cumulative volume and number distributions are drawn from smaller particle sizes across particle size classes (channels). The volume-based particle size D16v is defined as the particle size at which the cumulative volume percentage is 16%. The number-based particle size D16p is defined as the particle size at which the cumulative number percentage is 16%. The volume average particle size D50v is defined as the particle size at which the cumulative volume percentage is 50%. The number average particle size D50p is defined as the particle size at which the cumulative number percentage is 50%. The volume-based particle size D84v is defined as the particle size at which the cumulative volume percentage is 84%. The number-based particle size D84p is defined as the particle size at which the cumulative number percentage is 84%.

From these particle sizes, the volume-based particle size distribution index (GSDv) is calculated as $(D84v/D16v)^{1/2}$, and the number-based particle size distribution index (GSDp) is calculated as $(D84p/D16p)^{1/2}$.

The toner particles preferably have a shape factor SF1 of 110 to 150, more preferably 120 to 140.

The shape factor SF1 may be calculated by the following equation:

$$SF1=(ML^2/A)\times(\pi/4)\times 100$$

where ML is the absolute maximum length of the toner particles, and A is the projected area of the toner particles.

Typically, the shape factor SF1 is determined by analyzing a light micrograph or scanning electron micrograph (SEM) using an image analyzer as follows. A micrograph of particles dispersed over a glass slide is captured into a Luzex image analyzer using a video recorder. The maximum lengths and projected areas of 100 particles are determined and substituted into the above equation to obtain the shape factors SF1 of the individual particles, and the average shape factor SF1 is calculated.

External Additive

The toner according to this exemplary embodiment may contain external additives other than particles of metallic salts of fatty acids. Examples of other external additives include the following inorganic particles and resin particles.

Examples of inorganic particles that may be used as external additives include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$ and $MgSO_4$.

The surface of the inorganic particles used as an external additive may be subjected to hydrophobic treatment. The hydrophobic treatment may be performed, for example, by immersing the inorganic particles in a hydrophobic agent. Non-limiting examples of hydrophobic agents include silane coupling agents, silicone oils, titanate coupling agents, and aluminum coupling agents. These hydrophobic agents may be used alone or in combination.

The hydrophobic agent is typically used in an amount of 1 to 10 parts by mass per 100 parts by mass of the inorganic particles.

Other examples of external additives include resin particles (e.g., polystyrene, polymethyl methacrylate, and melamine resin particles) and cleaning activators (e.g., fluoropolymer particles).

The external additive is preferably present in an amount of, for example, 0.01% to 5% by mass, more preferably 0.01% to 2.0% by mass, of the toner particles.

Method for Manufacturing Toner

A method for manufacturing the toner according to this exemplary embodiment will now be described.

The toner according to this exemplary embodiment may be manufactured by preparing toner particles and then adding an external additive to the toner particles.

The toner particles may be manufactured by dry processes (e.g., pulverization) or by wet processes (e.g., aggregation coalescence, suspension polymerization, and dissolution suspension). The toner particles may be manufactured by any known process. For example, the toner particles may be manufactured by aggregation coalescence.

An example method for manufacturing the toner particles by aggregation coalescence includes providing a resin particle dispersion in which resin particles serving as a binder resin are dispersed (resin-particle-dispersion providing step); aggregating the resin particles (and optionally other particles) in the resin particle dispersion (optionally mixed with other particle dispersions) to form aggregated particles (aggregated-particle forming step); and coalescing the aggregated particles by heating the aggregated particle dispersion to form toner particles (coalescing step).

The individual steps will now be described in detail.

Although the following description is directed to a method for manufacturing toner particles containing a colorant and a release agent, it should be understood that these additives are optional. Other additives may also be used.

Resin-Particle-Dispersion Providing Step

A resin particle dispersion in which resin particles serving as a binder resin are dispersed is provided. Also provided are, for example, a colorant particle dispersion in which colorant particles are dispersed and a release agent particle dispersion in which release agent particles are dispersed.

The resin particle dispersion may be prepared, for example, by dispersing resin particles with a surfactant in a dispersion medium.

Examples of dispersion media that may be used in the resin particle dispersion include aqueous media.

Examples of aqueous media include water, such as distilled water and ion exchange water, and alcohols. These aqueous media may be used alone or in combination.

Examples of surfactants include anionic surfactants such as sulfates, sulfonates, phosphates, and soaps; cationic surfactants such as amine salts and quaternary ammonium salts; and nonionic surfactants such as polyethylene glycol derivatives, ethylene oxide adducts of alkylphenols, and polyhydric alcohol derivatives. For example, anionic or cationic surfactants may be used. Nonionic surfactants may be used in combination with anionic or cationic surfactants.

These surfactants may be used alone or in combination.

The resin particles may be dispersed in the dispersion medium by a common dispersion process, for example, using a rotary shear homogenizer or a media mill such as a ball mill, sand mill, or Dyno mill. Depending on the type of resin particles, the resin particles may be dispersed in the dispersion medium by phase-inversion emulsification. Phase-inversion emulsification is the process of dispersing a resin in the form of particles in an aqueous medium by dissolving the resin in a hydrophobic organic solvent in which the resin is soluble, adding a base to neutralize the organic continuous phase (O-phase), and adding an aqueous medium (W-phase) to induce phase inversion from water-in-oil (W/O) to oil-in-water (O/W).

The resin particles dispersed in the resin particle dispersion preferably have a volume average particle size of, for example, 0.01 to 1 μm, more preferably 0.08 to 0.8 μm, even more preferably 0.1 to 0.6 μm.

The volume average particle size of the resin particles may be determined as follows. A volume-based particle size distribution is obtained by a laser diffraction particle size distribution analyzer (e.g., LA-700, Horiba, Ltd.). Based on the resulting particle size distribution, a cumulative volume distribution is drawn from smaller particle sizes across particle size classes (channels). The volume average particle size D50v is determined as the particle size at which the cumulative volume percentage is 50% of all the particles. The volume average particle sizes of the particles dispersed in the other dispersions may be determined in the same manner.

The resin particles are preferably present in the resin particle dispersion in an amount of, for example, 5% to 50% by mass, more preferably 10% to 40% by mass.

The colorant particle dispersion and the release agent particle dispersion, for example, may be prepared in the same manner as the resin particle dispersion. The colorant particle dispersion and the release agent particle dispersion may be similar in volume average particle size, the type of dispersion medium, the type of dispersion process, and particle content to the resin particle dispersion.

Aggregated-Particle Forming Step

The resin particle dispersion, the colorant particle dispersion, and the release agent particle dispersion are mixed together.

The resin particles, the colorant particles, and the release agent particles in the mixed dispersion are subjected to heteroaggregation to form aggregated particles including the resin particles, the colorant particles, and the release agent particles. The aggregated particles are close in size to the target toner particles.

The aggregated particles may be formed, for example, by adding a coagulant to the mixed dispersion, adjusting the mixed dispersion to an acidic pH (e.g., a pH of 2 to 5), optionally adding a dispersion stabilizer, and heating the mixed dispersion to aggregate the particles dispersed in the mixed dispersion. The mixed dispersion is heated to a temperature close to the glass transition temperature of the resin particles (e.g., to 10° C. to 30° C. lower than the glass transition temperature of the resin particles).

For example, the aggregated-particle forming step may involve adding a coagulant to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and heating the mixed dispersion.

Examples of coagulants include surfactants of opposite polarity to the surfactant present in the mixed dispersion, inorganic metal salts, and metal complexes having a valence of 2 or more. For example, the use of metal complexes may allow for a reduction in the amount of surfactant used and thus improved charging characteristics.

The coagulant may optionally be used in combination with an additive that forms a complex or similar linkage with metal ions from the coagulant. An example of such an additive is a chelating agent.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The chelating agent is preferably added in an amount of, for example, 0.01 to 5.0 parts by mass, more preferably 0.1 to less than 3.0 parts by mass, per 100 parts by mass of the resin particles.

Coalescing Step

The aggregated particles are coalesced to form toner particles, for example, by heating the aggregated particle dispersion to at least the glass transition temperature of the resin particles (e.g., to at least 10° C. to 30° C. higher than the glass transition temperature of the resin particles).

In this way, the toner particles are prepared.

Alternatively, the toner particles may be manufactured by preparing an aggregated particle dispersion in which aggregated particles are dispersed, mixing the aggregated particle dispersion with a resin particle dispersion in which resin particles are dispersed, aggregating the resin particles on the surface of the aggregated particles to form second aggregated particles, and coalescing the second aggregated particles by heating the second aggregated particle dispersion to form core-shell toner particles.

After the coalescing step is complete, the toner particles in the dispersion are subjected to known washing, solid-liquid separation, and drying steps to obtain dry toner particles. The washing step may involve sufficiently washing the toner particles by displacement washing with ion exchange water for reasons of charging characteristics. The solid-liquid separation step may involve, for example, suction filtration or pressure filtration for reasons of productivity. The drying step may involve, for example, freeze drying, flush jet drying, fluidized bed drying, or vibrating fluidized bed drying for reasons of productivity.

The toner according to this exemplary embodiment may be manufactured, for example, by mixing an external additive with the resulting dry toner particles. The external additive may be mixed, for example, using a V-blender, Henschel mixer, or Lodige mixer. Optionally, coarse toner particles may be removed, for example, using a vibrating sieve or air sieve.

Electrostatic Image Developer

An electrostatic image developer according to an exemplary embodiment contains at least a toner according to an exemplary embodiment. The electrostatic image developer according to this exemplary embodiment may be a one-component developer containing only a toner according to an exemplary embodiment or a two-component developer containing the toner and a carrier.

The carrier may be any known carrier. For example, the carrier may be a coated carrier, which is made of a magnetic powder serving as a core and coated with a resin, a magnetic powder dispersion carrier, which is made of a dispersion of a magnetic powder in a matrix resin, or a resin-impregnated carrier, which is made of a porous magnetic powder impregnated with a resin. A magnetic powder dispersion carrier or resin-impregnated carrier may be used as a core and coated with a resin.

Examples of magnetic powders include magnetic metals such as iron, nickel, and cobalt and magnetic oxides such as ferrite and magnetite.

Examples of coating resins and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylic acid copolymers, straight silicone resins containing organosiloxane bonds and derivatives thereof, fluoropolymers, polyesters, polycarbonates, phenolic resins, and epoxy resins. The coating resin and the matrix resin may contain additives such as conductive particles. Examples of conductive particles include metals such as gold, silver, and copper and other materials such as carbon black, titanium oxide, zinc oxide, tin oxide, barium sulfate, aluminum borate, and potassium titanate.

The core may be coated with the coating resin, for example, using a solution of the coating resin and various additives (optional) in a suitable solvent. The solvent may be any solvent selected depending on factors such as the type of resin used and the suitability for coating. For example, the core may be coated with the coating resin by dipping, in which the core is dipped in the coating solution, by spraying, in which the core is sprayed with the coating solution, by fluidized bed coating, in which the core is sprayed with the coating solution while being suspended in a flow of air, or by kneader coating, in which the carrier core and the coating solution are mixed in a kneader coater before the solvent is removed therefrom.

The mixing ratio (by mass) of the toner to the carrier in the two-component developer is preferably 1:100 to 30:100, more preferably 3:100 to 20:100.

Image-Forming Apparatus and Method

An image-forming apparatus and method according to an exemplary embodiment will now be described.

The image-forming apparatus according to this exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, an intermediate transfer member to which the toner image is transferred from the surface of the image carrier, a first transfer unit that transfers the toner image from the surface of the image carrier to a surface of the intermediate transfer member, a second transfer unit that transfers the toner image from the surface of the intermediate transfer member to a surface of a recording medium, a fixing unit that fixes the toner image to the surface of the recording medium, and a cleaning unit that includes a blade disposed in contact with the surface of the intermediate transfer member and that removes residual toner from the surface of the intermediate transfer member with the blade after the transfer of the toner image to the recording medium. The electrostatic image developer is an electrostatic image developer according to an exemplary embodiment.

The image-forming apparatus according to this exemplary embodiment executes an image-forming method (image-forming method according to this exemplary embodiment) including a charging step of charging the surface of the image carrier, an electrostatic-image forming step of forming an electrostatic image on the charged surface of the image carrier, a developing step of developing the electrostatic image formed on the surface of the image carrier with an electrostatic image developer according to an exemplary embodiment to form a toner image, a first transfer step of transferring the toner image from the surface of the image carrier to the surface of the intermediate transfer member, a second transfer step of transferring the toner image from the surface of the intermediate transfer member to a surface of a recording medium, a fixing step of fixing the toner image to the surface of the recording medium, and a cleaning step of removing residual toner from the surface of the intermediate transfer member with the blade disposed in contact with the surface of the intermediate transfer member after the transfer of the toner image to the recording medium.

The image-forming apparatus according to this exemplary embodiment may be a known type of image-forming apparatus. For example, the image-forming apparatus according to this exemplary embodiment may include an image-carrier cleaning unit that cleans the surface of the image carrier after the transfer of the toner image and before charging and an erase unit that erases charge from the surface of the image carrier by exposure to erase light after the transfer of the toner image and before charging.

The image-forming apparatus according to this exemplary embodiment may have a cartridge structure (process cartridge) attachable to and detachable from the image-forming apparatus and including, for example, a developing unit. The process cartridge may include, for example, a developing unit containing an electrostatic image developer according to an exemplary embodiment.

A non-limiting example of an image-forming apparatus according to an exemplary embodiment will now be described. The following description focuses on the parts shown in the drawings; other parts are not described herein.

FIG. 1 is a schematic view of an image-forming apparatus according to an exemplary embodiment.

The image-forming apparatus shown in FIG. 1 includes first to fourth electrophotographic image-forming units (hereinafter also simply referred to as "units") 10Y, 10M, 10C, and 10K that form yellow (Y), magenta (M), cyan (C), and black (K) images, respectively, based on image data generated by color separation. These units 10Y, 10M, 10C, and 10K are arranged in parallel at a predetermined distance from each other in the horizontal direction. These units 10Y, 10M, 10C, and 10K may be process cartridges attachable to and detachable from the image-forming apparatus.

An intermediate transfer belt (an example of an intermediate transfer member) 20 is disposed over the units 10Y, 10M, 10C, and 10K and extends through the individual units 10Y, 10M, 10C, and 10K. The intermediate transfer belt 20 is entrained about a drive roller 22 and a support roller 24 that are disposed in contact with the inner surface of the intermediate transfer belt 20 and runs in the direction from the first unit 10Y toward the fourth unit 10K. The support roller 24 is urged away from the drive roller 22, for example, by a spring (not shown) so that the intermediate transfer belt 20 is tensioned therebetween. An intermediate-transfer-belt cleaning device 30 is disposed on the image-bearing side of the intermediate transfer belt 20 and faces the drive roller 22.

The intermediate transfer belt 20 includes, for example, a substrate layer and a surface layer disposed outside the substrate layer. The substrate layer contains, for example, a resin and a conductor. Examples of resins include polyimide, polyamide, polyamide-imide, polyether ester, polyarylate, and polyester resins. The surface layer contains, for example, at least one of the above resins, a fluoropolymer, and a conductor. The intermediate transfer belt 20 has a thickness of, for example, 50 to 100 μm.

The units 10Y, 10M, 10C, and 10K include developing devices (examples of developing units) 4Y, 4M, 4C, and 4K, respectively. The developing devices 4Y, 4M, 4C, and 4K are supplied with yellow, magenta, cyan, and black toners from toner cartridges 8Y, 8M, 8C, and 8K, respectively.

The first to fourth units 10Y, 10M, 10C, and 10K are similar in construction and operation. The following description focuses on the first unit 10Y, which is a yellow image-forming unit located upstream in the running direction of the intermediate transfer belt 20.

The first unit 10Y includes a photoreceptor 1Y serving as an image carrier. Around the photoreceptor 1Y are arranged, in sequence, a charging roller (an example of a charging unit) 2Y that charges the surface of the photoreceptor 1Y to a predetermined potential, an exposure device (an example of an electrostatic-image forming unit) 3 that exposes the charged surface of the photoreceptor 1Y to a laser beam 3Y based on an image signal generated by color separation to form an electrostatic image, a developing device (an example of a developing unit) 4Y that develops the electrostatic image with a charged toner to form a toner image, a first transfer roller (an example of a first transfer unit) 5Y that transfers the toner image to the intermediate transfer belt 20, and a photoreceptor cleaning device (an example of an image-carrier cleaning unit) 6Y that removes residual toner from the surface of the photoreceptor 1Y after the first transfer.

The first transfer roller 5Y is disposed inside the intermediate transfer belt 20 and faces the photoreceptor 1Y. Each of the first transfer rollers 5Y, 5M, 5C, and 5K of the unit 10Y, 10M, 10C, and 10K is connected to a bias supply (not shown) that applies a first transfer bias to the first transfer roller. The transfer bias applied to each first transfer roller is controlled by a controller (not shown).

The photoreceptor cleaning device 6Y includes a cleaning blade disposed in contact with the surface of the photoreceptor 1Y. After the toner image is transferred to the intermediate transfer belt 20, the photoreceptor 1Y continues to rotate, and the cleaning blade disposed in contact with the surface of the photoreceptor 1Y removes residual toner from the surface of the photoreceptor 1Y.

A second transfer roller (an example of a second transfer unit) 26 and the support roller 24 are disposed downstream of the fourth unit 10K. The second transfer roller 26 is disposed on the image-bearing side of the intermediate transfer belt 20. The support roller 24 is disposed in contact with the inner surface of the intermediate transfer belt 20. The second transfer roller 26 and the support roller 24 constitute a second transfer section.

The intermediate-transfer-belt cleaning device 30 includes a cleaning blade disposed in contact with the surface of the intermediate transfer belt 20. After the toner image is transferred to a recording medium, the intermediate transfer belt 20 continues to run, and the cleaning blade disposed in contact with the surface of the intermediate transfer belt 20 removes residual toner from the surface of the intermediate transfer belt 20. Examples of materials that may be used for the cleaning blade include thermosetting polyurethane rubbers, silicone rubbers, fluoroelastomers, and ethylene-propylene-diene rubbers. The cleaning blade has a thickness of, for example, 1 to 7 mm.

The process of forming a yellow image in the first unit 10Y will now be described.

This process begins after the charging roller 2Y charges the surface of the photoreceptor 1Y to a potential of −600 to −800 V.

The photoreceptor 1Y includes a conductive substrate (e.g., a substrate with a volume resistivity of $1\times10^{-6}$ Ωcm or less at 20° C.) and a photosensitive layer disposed thereon. When the photosensitive layer, which normally has high resistivity (i.e., similar to those of common resins), is exposed to a laser beam, its resistivity changes in the area exposed to the laser beam. The charged surface of the photoreceptor 1Y is exposed to the laser beam 3Y emitted from the exposure device 3 based on yellow image data fed from a controller (not shown). In this way, an electrostatic image corresponding to the yellow image pattern is formed on the surface of the photoreceptor 1Y.

The electrostatic image is an image formed on the surface of the photoreceptor 1Y by electric charge. Specifically, the electrostatic image is a negative latent image formed when electric charge dissipates from the surface of the photoreceptor 1Y in the area exposed to the laser beam 3Y due to decreased resistivity while remaining in the area not exposed to the laser beam 3Y.

The electrostatic image formed on the photoreceptor 1Y is transported to a predetermined developing position by the rotation of the photoreceptor 1Y. The electrostatic image on the photoreceptor 1Y is developed into a visible toner image at the developing position by the developing device 4Y.

The developing device 4Y contains, for example, an electrostatic image developer containing at least a yellow toner and a carrier. The yellow toner is charged by friction to the same polarity (negative) as the surface of the photoreceptor 1Y while being stirred in the developing device 4Y and is carried by a developer roller (an example of a developer carrier). As the surface of the photoreceptor 1Y passes through the developing device 4Y, the yellow toner is electrostatically attracted to the latent image on the surface of the photoreceptor 1Y to develop the latent image. The photoreceptor 1Y continues to rotate at a predetermined speed, and the yellow toner image formed on the photoreceptor 1Y is transported to a predetermined first transfer position.

When the yellow toner image on the photoreceptor 1Y is transported to the first transfer position, the first transfer bias is applied to the first transfer roller 5Y. The first transfer bias produces an electrostatic force acting on the toner image from the photoreceptor 1Y toward the first transfer roller 5Y to transfer the toner image from the photoreceptor 1Y to the intermediate transfer belt 20. The transfer bias applied to the first transfer roller 5Y has the opposite polarity (positive) to the toner (negative). The transfer current through the first unit 10Y is controlled to, for example, +10 μA by a controller (not shown).

After the toner image is transferred to the intermediate transfer belt 20, the photoreceptor 1Y continues to rotate, and the photoreceptor cleaning device 6Y removes and collects residual toner from the photoreceptor 1Y with the cleaning blade in contact therewith.

The first transfer biases applied to the first transfer rollers 5M, 5C, and 5K of the second, third, and fourth units 10M, 10C, and 10K are controlled in the same manner as the first transfer bias applied to the first transfer roller 5Y of the first unit 10Y.

After the yellow toner image is transferred to the intermediate transfer belt 20 in the first unit 10Y, the intermediate transfer belt 20 sequentially passes through the second, third, and fourth units 10M, 10C, and 10K. In this way, the toner images of the four colors are transferred to the intermediate transfer belt 20 in superimposed registration with each other.

After the toner images of the four colors are transferred to the intermediate transfer belt 20 in superimposed registration with each other in the first to fourth units 10Y, 10M, 10C, and 10K, the multicolor toner image is transported to the second transfer section. The second transfer section includes the intermediate transfer belt 20, the support roller 24, and the second transfer roller 26. A sheet of recording paper (an example of a recording medium) P is fed into the nip between the second transfer roller 26 and the intermediate transfer belt 20 at a predetermined timing by a feeder. A second transfer bias is applied to the support roller 24. The second transfer bias, which has the same polarity (negative) as the toner (negative), produces an electrostatic force acting on the toner image from the intermediate transfer belt 20 toward the recording paper P to transfer the toner image from the intermediate transfer belt 20 to the recording paper P. The second transfer bias is determined and controlled depending on the resistance detected by a resistance detector (not shown) that detects the resistance of the second transfer section.

After the toner image is transferred to the recording paper P, the intermediate transfer belt 20 continues to run, and the intermediate-transfer-belt cleaning device 30 removes and collects residual toner from the intermediate transfer belt 20 with the cleaning blade in contact therewith. The contact pressure of the cleaning blade (pressure applied across the thickness of the intermediate transfer belt 20) is, for example, 1 to 5 g/mm. The contact angle of the cleaning blade is, for example, 5° to 30°. The contact width of the cleaning blade is, for example, 0.1 to 2 mm.

After the toner image is transferred to the recording paper P, the recording paper P is transported into the nip between a pair of fixing rollers of a fixing device (an example of a fixing unit) 28. The fixing device 28 fixes the toner image to the recording paper P to form a fixed image. After the multicolor image is fixed to the recording paper P, the recording paper P is transported to an output section. The multicolor image-forming process is complete.

The recording paper P to which the toner image is transferred may be, for example, plain paper for use in electrophotographic systems such as copiers and printers. Examples of recording media other than the recording paper P include OHP sheets. The surface of the recording paper P may be smoothed to improve the surface smoothness of the fixed image. For example, the recording paper P may be coated paper, which is plain paper coated with a resin or other material, or art paper for printing.

Process Cartridge and Toner Cartridge

A process cartridge attachable to and detachable from an image-forming apparatus according to an exemplary embodiment includes, for example, a developing unit that contains an electrostatic image developer according to an exemplary embodiment and that develops an electrostatic image formed on a surface of an image carrier with the electrostatic image developer to form a toner image, an intermediate transfer member to which the toner image is transferred from the surface of the image carrier, and a cleaning unit that includes a blade disposed in contact with a surface of the intermediate transfer member and that removes residual toner from the surface of the intermediate transfer member with the blade after the transfer of the toner image to a surface of a recording medium.

A process cartridge attachable to and detachable from an image-forming apparatus according to another exemplary embodiment includes a developing unit, an intermediate transfer member, a cleaning unit for the intermediate transfer member, and at least one unit selected from an image carrier, a charging unit, an electrostatic-image forming unit, and other units. A process cartridge attachable to and detachable from an image-forming apparatus according to yet another exemplary embodiment does not include an intermediate transfer member or a cleaning unit for the intermediate transfer member but includes at least a developing unit containing an electrostatic image developer according to an exemplary embodiment.

An example process cartridge attachable to and detachable from an image-forming apparatus according to an exemplary embodiment will now be described. The following description focuses on the parts shown in the drawings; other parts are not described herein.

Figure 2:
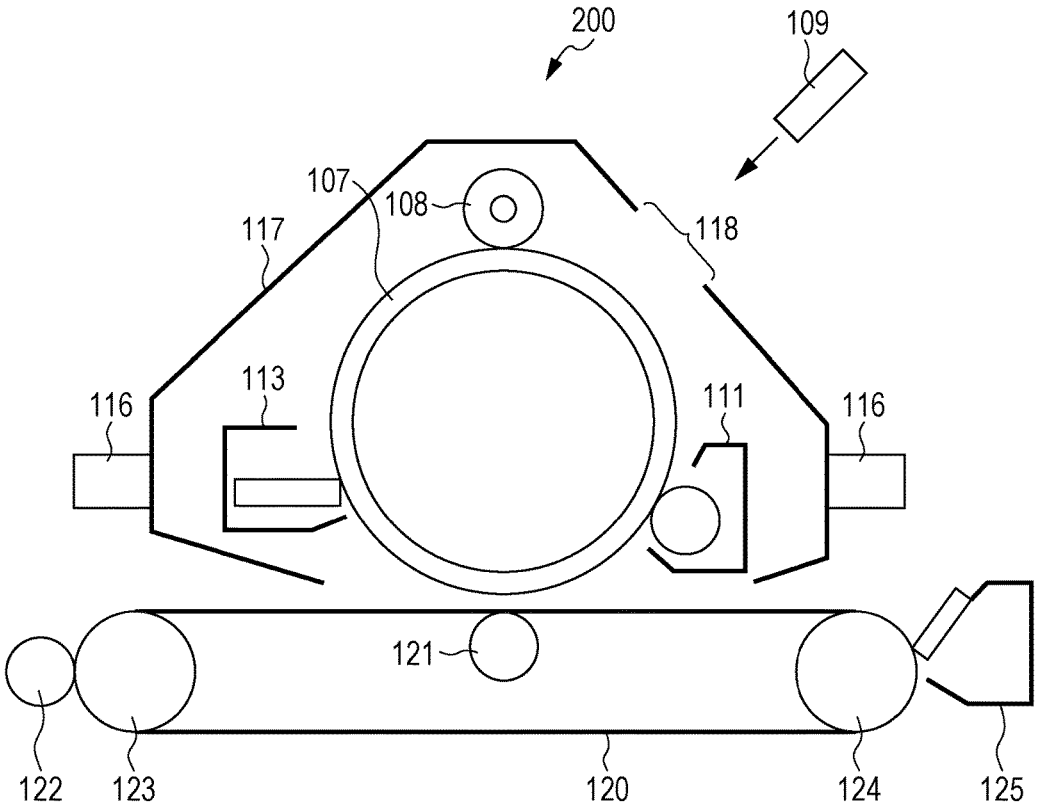
FIG. 2 is a schematic view of an example process cartridge attachable to and detachable from an image-forming apparatus according to an exemplary embodiment.

FIG. 2 is a schematic view of an example process cartridge attachable to and detachable from an image-forming apparatus according to an exemplary embodiment. A process cartridge 200 shown in FIG. 2 includes a photoreceptor (an example of an image carrier) 107. Around the photoreceptor 107 are arranged a charging roller (an example of a charging unit) 108, a developing device (an example of a developing unit) 111, and a photoreceptor cleaning device (an example of an image-carrier cleaning unit) 113. The photoreceptor 107, the charging roller 108, the developing device 111, and the photoreceptor cleaning device 113 are held together by a housing 117 having mounting rails 116 and an exposure opening 118. The process cartridge 200 is combined with an intermediate transfer belt (an example of an intermediate transfer member) 120, a first transfer roller (an example of a first transfer unit) 121, a second transfer roller (an example of a second transfer unit) 122, a support roller 123, a drive roller 124, and an intermediate-transfer-belt cleaning device (an example of an intermediate-transfer-belt cleaning unit) 125. The photoreceptor cleaning device 113 includes a blade disposed in contact with the photoreceptor 107. The intermediate-transfer-belt cleaning device 125 includes a blade disposed in contact with the intermediate transfer belt 120. When the photoreceptor 107 is mounted in an image-forming apparatus and is used to form an image, an exposure device (an example of an electrostatic-image forming unit) 109 exposes the surface of the photoreceptor 107 to form an electrostatic latent image.

A process cartridge attachable to and detachable from an image-forming apparatus according to another exemplary embodiment is a tandem process cartridge including image-forming units (e.g., image-forming units each including the devices held together by the housing 117 in FIG. 2) that form toner images of different colors. The image-forming units are arranged in parallel on the image-bearing side of an intermediate transfer belt.

A toner cartridge according to an exemplary embodiment of the present invention will now be described.

The toner cartridge according to this exemplary embodiment is attachable to and detachable from an image-forming apparatus and contains a toner according to an exemplary embodiment. The toner cartridge contains refill toner to be supplied to a developing unit disposed in an image-forming apparatus.

The image-forming apparatus shown in FIG. 1 includes the toner cartridges 8Y, 8M, 8C, and 8K, which are attachable to and detachable from the image-forming apparatus. The developing devices 4Y, 4M, 4C, and 4K are connected to the toner cartridges 8Y, 8M, 8C, and 8K, respectively, through toner supply tubes (not shown). The toner cartridges 8Y, 8M, 8C, and 8K are replaced when the toner level is low.

EXAMPLES

Exemplary embodiments of the present invention are further illustrated by the following non-limiting examples. In the following description, parts are by mass unless otherwise specified.

Preparation of Resin Particle Dispersion

Terephthalic acid: 30 molar parts

Fumaric acid: 70 molar parts

Ethylene oxide adduct of bisphenol A: 5 molar parts

Propylene oxide adduct of bisphenol A: 95 molar parts

The ingredients listed above are placed in a 5 L flask equipped with a stirrer, a nitrogen inlet tube, a temperature sensor, and a fractionating column. The mixture is heated to 220° C. over 1 hour. Titanium tetraethoxide is added in an amount of 1 part per 100 parts of the mixture. The mixture is heated to 230° C. over 0.5 hour and is maintained at the same temperature for 1 hour to run a dehydration condensation reaction while water is distilled off. The reaction mixture is cooled to obtain a polyester resin having a weight average molecular weight of 18,000 and a glass transition temperature of 60° C.

In a vessel equipped with a temperature control unit and a nitrogen purging unit are placed 40 parts of ethyl acetate and 25 parts of 2-butanol. To the mixture is gradually added and dissolved 100 parts of the polyester resin. To the mixture is added 10% by mass aqueous ammonia (in a molar ratio equal to three times the acid value of the resin). The mixture is stirred for 30 minutes. The vessel is then purged with dry nitrogen. While the mixture is maintained at 40° C., 400 parts of ion exchange water is added dropwise at a rate of 2 parts per minute with stirring. After the addition is complete, the mixture is returned to room temperature (20° C. to 25° C.) and is bubbled with dry nitrogen with stirring for 48 hours to obtain a resin particle dispersion in which resin particles are dispersed with ethyl acetate and 2-butanol concentrations of 1,000 ppm or less. The resin particle dispersion is diluted with ion exchange water to a solid content of 20% by mass.

Preparation of Colorant Dispersions

Preparation of Colorant Dispersion (K)

Carbon black (NIPEX, Orion Engineered Carbons): 70 parts

Anionic surfactant (Neogen RK, DKS Co. Ltd.): 5 parts

Ion exchange water: 200 parts

The ingredients listed above are mixed and dispersed using a homogenizer (Ultra-Turrax T50, IKA) for 10 minutes. The resulting dispersion is diluted with ion exchange water to a solid content of 20% by mass to obtain Colorant Dispersion (K), which contains colorant particles having a volume average particle size of 170 nm.

Preparation of Colorant Dispersion (C)

Colorant Dispersion (C) is prepared in the same manner as Colorant Dispersion (K) except that the colorant (pigment) is replaced with C.I. Pigment Blue 15:3 (Dainichiseika Color & Chemicals Mfg. Co., Ltd.).

Preparation of Release Agent Dispersion

Paraffin wax (HNP-9, Nippon Seiro Co., Ltd.): 100 parts

Anionic surfactant (Neogen RK, DKS Co. Ltd.): 1 part

Ion exchange water: 350 parts

The ingredients listed above are mixed and heated to 100° C., are dispersed using a homogenizer (Ultra-Turrax T50, IKA), and are dispersed using a Manton-Gaulin high-pressure homogenizer (Gaulin) to obtain a release agent dispersion in which release agent particles having a volume average particle size of 200 nm are dispersed (solid content=20% by mass).

Preparation of Particles of Metallic Salts of Fatty Acids

Preparation of Particles of Metallic Salt of Fatty Acid (1)

Zinc stearate (Kawamura Kasei Industry Co., Ltd.): 100 parts

Iron(III) stearate (Tokyo Chemical Industry Co., Ltd.): 0.0081 part

In a first heatable stainless steel reactor equipped with a stirrer and a temperature sensor, 200 parts of pure water is placed and heated to 70° C. with stirring. In a second heatable stainless steel reactor equipped with a stirrer and a temperature sensor, a metallic salt of a fatty acid (zinc stearate) and iron(III) stearate are placed and melted. The molten metallic salt of the fatty acid is added to the pure water in the first stainless steel reactor. The mixture is heated again to 70° C. with stirring. To the mixture, a solution of 2 parts of sodium hydroxide in 100 parts of pure water is added dropwise to emulsify the metallic salt of the fatty acid. The mixture is then heated to 80° C. and is left standing for 60 minutes. The reaction mixture is washed with water, filtered, dehydrated, and dried to obtain a solid of the metallic salt of the fatty acid. The solid of the metallic salt of the fatty acid is pulverized in a ball mill to obtain Particles of Metallic Salt of Fatty Acid (1), which have a volume average particle size of 0.8 μm.

Preparation of Particles of Metallic Salts of Fatty Acids (2) to (60)

Particles of Metallic Salts of Fatty Acids (2) to (60) are prepared in the same manner as Particles of Metallic Salt of Fatty Acid (1) except that the types and amounts of the metallic salt of the fatty acid and the iron compound are changed shown in Tables 1 to 5.

Tables 1 to 5 show the metallic salts of the fatty acids and the iron compounds used for the preparation of Particles of Metallic Salts of Fatty Acids (1) to (60).

TABLE 1

| | Metallic salt of fatty acid | | Iron compound | |
|---|---|---|---|---|
| | Type | Amount (parts) | Type | Amount (parts) |
| (1) | Zinc stearate | 100 | Iron(III) stearate | 0.0081 |
| (2) | Zinc stearate | 100 | Iron(III) stearate | 0.0146 |
| (3) | Zinc stearate | 100 | Iron(III) stearate | 0.0178 |
| (4) | Zinc stearate | 100 | Iron(III) stearate | 0.0454 |
| (5) | Zinc stearate | 100 | Iron(III) stearate | 0.0535 |
| (6) | Zinc stearate | 100 | Iron(III) stearate | 0.0811 |
| (7) | Zinc stearate | 100 | Iron(III) stearate | 0.0925 |
| (8) | Zinc stearate | 100 | Iron(III) stearate | 0.1006 |
| (9) | Zinc stearate | 100 | Iron(III) stearate | 0.1250 |
| (10) | Zinc stearate | 100 | Iron(III) stearate | 0.1348 |
| (11) | Zinc stearate | 100 | Iron(III) stearate | 0.1592 |
| (12) | Zinc stearate | 100 | Iron(III) stearate | 0.1754 |

TABLE 2

| | Metallic salt of fatty acid | | Iron compound | |
|---|---|---|---|---|
| | Type | Amount (parts) | Type | Amount (parts) |
| (13) | Calcium stearate | 100 | Iron(III) stearate | 0.0081 |
| (14) | Calcium stearate | 100 | Iron(III) stearate | 0.0146 |
| (15) | Calcium stearate | 100 | Iron(III) stearate | 0.0178 |
| (16) | Calcium stearate | 100 | Iron(III) stearate | 0.0454 |
| (17) | Calcium stearate | 100 | Iron(III) stearate | 0.0535 |
| (18) | Calcium stearate | 100 | Iron(III) stearate | 0.0844 |
| (19) | Calcium stearate | 100 | Iron(III) stearate | 0.0925 |
| (20) | Calcium stearate | 100 | Iron(III) stearate | 0.1006 |
| (21) | Calcium stearate | 100 | Iron(III) stearate | 0.1250 |
| (22) | Calcium stearate | 100 | Iron(III) stearate | 0.1348 |
| (23) | Calcium stearate | 100 | Iron(III) stearate | 0.1592 |
| (24) | Calcium stearate | 100 | Iron(III) stearate | 0.1754 |

TABLE 3

| | Metallic salt of fatty acid | | Iron compound | |
|---|---|---|---|---|
| | Type | Amount (parts) | Type | Amount (parts) |
| (25) | Magnesium stearate | 100 | Iron(III) stearate | 0.0081 |
| (26) | Magnesium stearate | 100 | Iron(III) stearate | 0.0146 |
| (27) | Magnesium stearate | 100 | Iron(III) stearate | 0.0178 |
| (28) | Magnesium stearate | 100 | Iron(III) stearate | 0.0454 |
| (29) | Magnesium stearate | 100 | Iron(III) stearate | 0.0535 |
| (30) | Magnesium stearate | 100 | Iron(III) stearate | 0.0828 |
| (31) | Magnesium stearate | 100 | Iron(III) stearate | 0.0925 |
| (32) | Magnesium stearate | 100 | Iron(III) stearate | 0.1006 |
| (33) | Magnesium stearate | 100 | Iron(III) stearate | 0.1250 |
| (34) | Magnesium stearate | 100 | Iron(III) stearate | 0.1348 |
| (35) | Magnesium stearate | 100 | Iron(III) stearate | 0.1592 |
| (36) | Magnesium stearate | 100 | Iron(III) stearate | 0.1754 |

TABLE 4

| | Metallic salt of fatty acid | | Iron compound | |
|---|---|---|---|---|
| | Type | Amount (parts) | Type | Amount (parts) |
| (37) | Zinc laurate | 100 | Iron(III) stearate | 0.0081 |
| (38) | Zinc laurate | 100 | Iron(III) stearate | 0.0146 |
| (39) | Zinc laurate | 100 | Iron(III) stearate | 0.0178 |

TABLE 4-continued

| | Metallic salt of fatty acid | | Iron compound | |
|---|---|---|---|---|
| | Type | Amount (parts) | Type | Amount (parts) |
| (40) | Zinc laurate | 100 | Iron(III) stearate | 0.0454 |
| (41) | Zinc laurate | 100 | Iron(III) stearate | 0.0535 |
| (42) | Zinc laurate | 100 | Iron(III) stearate | 0.0779 |
| (43) | Zinc laurate | 100 | Iron(III) stearate | 0.0925 |
| (44) | Zinc laurate | 100 | Iron(III) stearate | 0.1006 |
| (45) | Zinc laurate | 100 | Iron(III) stearate | 0.1250 |
| (46) | Zinc laurate | 100 | Iron(III) stearate | 0.1348 |
| (47) | Zinc laurate | 100 | Iron(III) stearate | 0.1592 |
| (48) | Zinc laurate | 100 | Iron(III) stearate | 0.1754 |

TABLE 5

| | Metallic salt of fatty acid | | Iron compound | |
|---|---|---|---|---|
| | Type | Amount (parts) | Type | Amount (parts) |
| (49) | Zinc stearate | 100 | Iron(III) nitrate | 0.00217 |
| (50) | Zinc stearate | 100 | Iron(III) nitrate | 0.00390 |
| (51) | Zinc stearate | 100 | Iron(III) nitrate | 0.00477 |
| (52) | Zinc stearate | 100 | Iron(III) nitrate | 0.01214 |
| (53) | Zinc stearate | 100 | Iron(III) nitrate | 0.01430 |
| (54) | Zinc stearate | 100 | Iron(III) nitrate | 0.02167 |
| (55) | Zinc stearate | 100 | Iron(III) nitrate | 0.02471 |
| (56) | Zinc stearate | 100 | Iron(III) nitrate | 0.02687 |
| (57) | Zinc stearate | 100 | Iron(III) nitrate | 0.03338 |
| (58) | Zinc stearate | 100 | Iron(III) nitrate | 0.03598 |
| (59) | Zinc stearate | 100 | Iron(III) nitrate | 0.04249 |
| (60) | Zinc stearate | 100 | Iron(III) nitrate | 0.04682 |

Preparation of Toners

Preparation of Toner (1)

Resin particle dispersion: 403 parts

Colorant Dispersion (K): 12 parts

Release agent dispersion: 50 parts

Anionic surfactant (Taycapower): 2 parts

The ingredients listed above are placed in a round-bottom stainless steel flask. The mixture is adjusted to a pH of 3.5 with 0.1 N nitric acid. To the mixture is added 30 parts of an aqueous nitric acid solution containing 10% by mass of polyaluminum chloride. The mixture is dispersed at 30° C. using a homogenizer (Ultra-Turrax T50, IKA) and is heated to and maintained at 45° C. in a heating oil bath for 30 minutes. To the mixture is added 100 parts of the resin particle dispersion, and the mixture is maintained at the same temperature for 1 hour. The mixture is then adjusted to a pH of 8.5 with 0.1 N aqueous sodium hydroxide solution and is heated to and maintained at 85° C. with stirring for 5 hours. The reaction mixture is cooled to 20° C. at 20° C./min, is filtered, is sufficiently washed with ion exchange water, and is dried to obtain Toner Particles (1), which have a volume average particle size of 7.5 μm.

In a Henschel mixer, 100 parts of Toner Particles (1), 0.7 part of silica particles treated with dimethyl silicone oil (RY200, Nippon Aerosil Co., Ltd.), and 0.1 part of Particles of Metallic Salt of Fatty Acid (1) are mixed at a speed of 30 m/s for 3 minutes to obtain Toner (1).

Preparation of Toners (2) to (60)

Toners (2) to (60) are prepared in the same manner as Toner (1) except that Particles of Metallic Salt of Fatty Acid (1) are replaced with Particles of Metallic Salts of Fatty Acids (2) to (60).

Preparation of Toners (61) to (72)

Toners (61) to (72) are prepared in the same manner as Toner (1) except that Colorant Dispersion (K) is replaced with Colorant Dispersion (C).

Preparation of Toners (73) to (79)

Toners (73) to (79) are prepared in the same manner as Toner (7) except that the amount of Particles of Metallic Salt of Fatty Acid (7) added is changed as shown in Table 12.

Preparation of Carrier

Ferrite particles (volume average particle size=35 μm): 100 parts

Toluene: 14 parts

Styrene-methyl methacrylate copolymer (copolymerization ratio=10:90): 2 parts

Carbon black (R330, Cabot Corporation): 0.2 part

The ingredients listed above except the ferrite particles are dispersed in a sand mill to prepare a dispersion. The dispersion and the ferrite particles are placed in a vacuum degassing kneader and are dried under reduced pressure with stirring to obtain a carrier.

Preparation of Developers

Preparation of Developers (1) to (79)

Toners (1) to (79) and the carrier are placed in a V-blender in a mass ratio of 8:92 and are stirred for 20 minutes. The mixtures are passed through a 212 μm mesh sieve to obtain Developers (1) to (79).

Elemental Analysis of Particles of Metallic Salt of Fatty Acid

Each of Developers (1) to (79) is passed through a jet sieve to separate the toner from the carrier. The separated toner is suspended in ion exchange water. The suspension is sonicated and filtered through filter paper (retention particle size=5 μm). The filtrate is centrifuged to separate the external additive of lower specific gravity as the particles of the metallic salt of the fatty acid. After drying, the particles of the metallic salt of the fatty acid are tested for the contents of iron and other metals by elemental analysis using an X-ray fluorescence spectrometer (XRF-1500, Shimadzu Corporation).

The compositions of Toners (1) to (79) (Developers (1) to (79)) and the results of the elemental analysis of the particles of the metallic salts of the fatty acids are shown in Tables 6 to 12.

Examples 1 to 67 and Comparative Examples 1 to 12

A modified Fuji-Xerox ApeosPort-4 C5570 printer is provided as an image-forming apparatus. This image-forming apparatus includes an intermediate transfer belt having a thickness of 80 μm (endless belt including a substrate layer containing a polyimide resin and a conductor and a surface layer containing a polyimide resin, a fluoropolymer, and a conductor) and an intermediate-transfer-belt cleaning device. The intermediate-transfer-belt cleaning device includes a cleaning blade made of a thermosetting polyurethane rubber and having a thickness of 2 mm. The cleaning blade is disposed in contact with the intermediate transfer belt at a contact pressure of 2.7 g/mm.

The image-forming apparatus is filled with any of Developers (1) to (79) and is used to print an image with an area coverage of 80% on 10,000 sheets of A4 paper. The image on the 10,000th sheet is visually inspected for the presence of lateral streaks. If a lateral streak is present, the width of the lateral streak is measured (if more than one lateral streak is present, the width of the widest lateral streak is measured). If no lateral streak is present on the 10,000th sheet, the same image is printed on additional 10,000 sheets. The prints are rated on the following scale, where G5 to G2 are acceptable. The results are shown in Tables 6 to 12.

G5: No lateral streak is present on the 10,000th sheet or 20,000th sheet.

G4: No lateral streak is present on the 10,000th sheet, and a lateral streak having a width of less than 0.5 mm is present on the 20,000th sheet.

G3: No lateral streak is present on the 10,000th sheet, and a lateral streak having a width of 0.5 mm or more is present on the 20,000th sheet.

G2: A lateral streak having a width of less than 0.5 mm is present on the 10,000th sheet.

G1: A lateral streak having a width of 0.5 mm or more is present on the 10,000th sheet.

TABLE 6

| | | | Particles of metallic salt of fatty acid | | | | | |
|---|---|---|---|---|---|---|---|---|
| | Toner (developer) | Colorant | No. | Fatty acid | Metal | Iron content (% by mass) | Ratio of iron to other metals (molar ratio) | Streaks |
| Comparative Example 1 | (1) | K | (1) | Stearic acid | Zinc | 0.0005 | $5.65 \times 10^{-5}$ | G1 |
| Example 1 | (2) | K | (2) | Stearic acid | Zinc | 0.0009 | $1.02 \times 10^{-4}$ | G3 |
| Example 2 | (3) | K | (3) | Stearic acid | Zinc | 0.0011 | $1.24 \times 10^{-4}$ | G4 |
| Example 3 | (4) | K | (4) | Stearic acid | Zinc | 0.0028 | $3.16 \times 10^{-4}$ | G4 |
| Example 4 | (5) | K | (5) | Stearic acid | Zinc | 0.0033 | $3.73 \times 10^{-4}$ | G5 |
| Example 5 | (6) | K | (6) | Stearic acid | Zinc | 0.0050 | $5.65 \times 10^{-4}$ | G5 |
| Example 6 | (7) | K | (7) | Stearic acid | Zinc | 0.0057 | $6.44 \times 10^{-4}$ | G5 |
| Example 7 | (8) | K | (8) | Stearic acid | Zinc | 0.0062 | $7.01 \times 10^{-4}$ | G4 |
| Example 8 | (9) | K | (9) | Stearic acid | Zinc | 0.0077 | $8.71 \times 10^{-4}$ | G4 |
| Example 9 | (10) | K | (10) | Stearic acid | Zinc | 0.0083 | $9.39 \times 10^{-4}$ | G3 |
| Example 10 | (11) | K | (11) | Stearic acid | Zinc | 0.0098 | $1.11 \times 10^{-3}$ | G2 |
| Comparative Example 2 | (12) | K | (12) | Stearic acid | Zinc | 0.0108 | $1.22 \times 10^{-3}$ | G1 |

TABLE 7

| | | | Particles of metallic salt of fatty acid | | | | | |
|---|---|---|---|---|---|---|---|---|
| | Toner (developer) | Colorant | No. | Fatty acid | Metal | Iron content (% by mass) | Ratio of iron to other metals (molar ration) | Streaks |
| Comparative Example 3 | (13) | K | (13) | Stearic acid | Calcium | 0.0005 | $5.42 \times 10^{-5}$ | G1 |
| Example 11 | (14) | K | (14) | Stearic acid | Calcium | 0.0009 | $9.76 \times 10^{-5}$ | G2 |
| Example 12 | (15) | K | (15) | Stearic acid | Calcium | 0.0011 | $1.19 \times 10^{-4}$ | G4 |
| Example 13 | (16) | K | (16) | Stearic acid | Calcium | 0.0028 | $3.04 \times 10^{-4}$ | G4 |
| Example 14 | (17) | K | (17) | Stearic acid | Calcium | 0.0033 | $3.58 \times 10^{-4}$ | G5 |
| Example 15 | (18) | K | (18) | Stearic acid | Calcium | 0.0052 | $5.65 \times 10^{-4}$ | G5 |
| Example 16 | (19) | K | (19) | Stearic acid | Calcium | 0.0057 | $6.19 \times 10^{-4}$ | G5 |
| Example 17 | (20) | K | (20) | Stearic acid | Calcium | 0.0062 | $6.73 \times 10^{-4}$ | G4 |
| Example 18 | (21) | K | (21) | Stearic acid | Calcium | 0.0077 | $8.36 \times 10^{-4}$ | G4 |
| Example 19 | (22) | K | (22) | Stearic acid | Calcium | 0.0083 | $9.01 \times 10^{-4}$ | G3 |
| Example 20 | (23) | K | (23) | Stearic acid | Calcium | 0.0098 | $1.06 \times 10^{-3}$ | G2 |
| Comparative Example 4 | (24) | K | (24) | Stearic acid | Calcium | 0.0108 | $1.17 \times 10^{-3}$ | G1 |

TABLE 8

| | | | Particles of metallic salt of fatty acid | | | | | |
|---|---|---|---|---|---|---|---|---|
| | Toner (developer) | Colorant | No. | Fatty acid | Metal | Iron content (% by mass) | Ratio of iron to other metals (molar ration) | Streaks |
| Comparative Example 5 | (25) | K | (25) | Stearic acid | Magnesium | 0.0005 | $5.29 \times 10^{-5}$ | G1 |
| Example 21 | (26) | K | (26) | Stearic acid | Magnesium | 0.0009 | $9.52 \times 10^{-5}$ | G2 |
| Example 22 | (27) | K | (27) | Stearic acid | Magnesium | 0.0011 | $1.16 \times 10^{-4}$ | G4 |
| Example 23 | (28) | K | (28) | Stearic acid | Magnesium | 0.0028 | $2.96 \times 10^{-4}$ | G4 |
| Example 24 | (29) | K | (29) | Stearic acid | Magnesium | 0.0033 | $3.49 \times 10^{-4}$ | G4 |
| Example 25 | (30) | K | (30) | Stearic acid | Magnesium | 0.0048 | $5.40 \times 10^{-4}$ | G4 |
| Example 26 | (31) | K | (31) | Stearic acid | Magnesium | 0.0057 | $6.03 \times 10^{-4}$ | G4 |
| Example 27 | (32) | K | (32) | Stearic acid | Magnesium | 0.0062 | $6.56 \times 10^{-4}$ | G4 |
| Example 28 | (33) | K | (33) | Stearic acid | Magnesium | 0.0077 | $8.15 \times 10^{-4}$ | G4 |
| Example 29 | (34) | K | (34) | Stearic acid | Magnesium | 0.0083 | $8.79 \times 10^{-4}$ | G3 |

TABLE 8-continued

| | Toner (developer) | Colorant | Particles of metallic salt of fatty acid | | | | | Streaks |
|---|---|---|---|---|---|---|---|---|
| | | | No. | Fatty acid | Metal | Iron content (% by mass) | Ratio of iron to other metals (molar ration) | |
| Example 30 | (35) | K | (35) | Stearic acid | Magnesium | 0.0098 | $1.04 \times 10^{-3}$ | G2 |
| Comparative Example 6 | (36) | K | (36) | Stearic acid | Magnesium | 0.0108 | $1.14 \times 10^{-3}$ | G1 |

TABLE 9

| | Toner (developer) | Colorant | Particles of metallic salt of fatty acid | | | | | Streaks |
|---|---|---|---|---|---|---|---|---|
| | | | No. | Fatty acid | Metal | Iron content (% by mass) | Ratio of iron to other metals (molar ration) | |
| Comparative Example 7 | (37) | K | (37) | Lauric acid | Zinc | 0.0005 | $4.15 \times 10^{-5}$ | G1 |
| Example 31 | (38) | K | (38) | Lauric acid | Zinc | 0.0009 | $7.46 \times 10^{-5}$ | G2 |
| Example 32 | (39) | K | (39) | Lauric acid | Zinc | 0.0011 | $9.12 \times 10^{-5}$ | G2 |
| Example 33 | (40) | K | (40) | Lauric acid | Zinc | 0.0028 | $2.32 \times 10^{-4}$ | G4 |
| Example 34 | (41) | K | (41) | Lauric acid | Zinc | 0.0033 | $2.74 \times 10^{-4}$ | G4 |
| Example 35 | (42) | K | (42) | Lauric acid | Zinc | 0.0048 | $3.98 \times 10^{-4}$ | G4 |
| Example 36 | (43) | K | (43) | Lauric acid | Zinc | 0.0057 | $4.73 \times 10^{-4}$ | G4 |
| Example 37 | (44) | K | (44) | Lauric acid | Zinc | 0.0062 | $5.14 \times 10^{-4}$ | G4 |
| Example 38 | (45) | K | (45) | Lauric acid | Zinc | 0.0077 | $6.39 \times 10^{-4}$ | G4 |
| Example 39 | (46) | K | (46) | Lauric acid | Zinc | 0.0083 | $6.89 \times 10^{-4}$ | G3 |
| Example 40 | (47) | K | (47) | Lauric acid | Zinc | 0.0098 | $8.14 \times 10^{-4}$ | G3 |
| Comparative Example 8 | (48) | K | (48) | Lauric acid | Zinc | 0.0108 | $8.97 \times 10^{-4}$ | G1 |

TABLE 10

| | Toner (developer) | Colorant | Particles of metallic salt of fatty acid | | | | | Streaks |
|---|---|---|---|---|---|---|---|---|
| | | | No. | Fatty acid | Metal | Iron content (% by mass) | Ratio of iron to other metals (molar ration) | |
| Comparative Example 9 | (49) | K | (49) | Stearic acid | Zinc | 0.0005 | $5.65 \times 10^{-5}$ | G1 |
| Example 41 | (50) | K | (50) | Stearic acid | Zinc | 0.0009 | $1.02 \times 10^{-4}$ | G3 |
| Example 42 | (51) | K | (51) | Stearic acid | Zinc | 0.0011 | $1.24 \times 10^{-4}$ | G3 |
| Example 43 | (52) | K | (52) | Stearic acid | Zinc | 0.0028 | $3.16 \times 10^{-4}$ | G4 |
| Example 44 | (53) | K | (53) | Stearic acid | Zinc | 0.0033 | $3.73 \times 10^{-4}$ | G4 |
| Example 45 | (54) | K | (54) | Stearic acid | Zinc | 0.0050 | $5.65 \times 10^{-4}$ | G4 |
| Example 46 | (55) | K | (55) | Stearic acid | Zinc | 0.0057 | $6.44 \times 10^{-4}$ | G4 |
| Example 47 | (56) | K | (56) | Stearic acid | Zinc | 0.0062 | $7.01 \times 10^{-4}$ | G4 |
| Example 48 | (57) | K | (57) | Stearic acid | Zinc | 0.0077 | $8.71 \times 10^{-4}$ | G4 |
| Example 49 | (58) | K | (58) | Stearic acid | Zinc | 0.0083 | $9.39 \times 10^{-4}$ | G3 |
| Example 50 | (59) | K | (59) | Stearic acid | Zinc | 0.0098 | $1.11 \times 10^{-3}$ | G2 |
| Comparative Example 10 | (60) | K | (60) | Stearic acid | Zinc | 0.0108 | $1.22 \times 10^{-3}$ | G1 |

TABLE 11

| | Toner (developer) | Colorant | Particles of metallic salt of fatty acid | | | | | Streaks |
|---|---|---|---|---|---|---|---|---|
| | | | No. | Fatty acid | Metal | Iron content (% by mass) | Ratio of iron to other metals (molar ration) | |
| Comparative Example 11 | (61) | C | (1) | Stearic acid | Zinc | 0.0005 | $5.65 \times 10^{-5}$ | G1 |
| Example 51 | (62) | C | (2) | Stearic acid | Zinc | 0.0009 | $1.02 \times 10^{-4}$ | G3 |
| Example 52 | (63) | C | (3) | Stearic acid | Zinc | 0.0011 | $1.24 \times 10^{-4}$ | G4 |
| Example 53 | (64) | C | (4) | Stearic acid | Zinc | 0.0028 | $3.16 \times 10^{-4}$ | G4 |

TABLE 11-continued

| | Toner (developer) | Colorant | Particles of metallic salt of fatty acid No. | Fatty acid | Metal | Iron content (% by mass) | Ratio of iron to other metals (molar ration) | Streaks |
|---|---|---|---|---|---|---|---|---|
| Example 54 | (65) | C | (5) | Stearic acid | Zinc | 0.0033 | $3.73 \times 10^{-4}$ | G5 |
| Example 55 | (66) | C | (6) | Stearic acid | Zinc | 0.0050 | $5.65 \times 10^{-4}$ | G5 |
| Example 56 | (67) | C | (7) | Stearic acid | Zinc | 0.0057 | $6.44 \times 10^{-4}$ | G5 |
| Example 57 | (68) | C | (8) | Stearic acid | Zinc | 0.0062 | $7.01 \times 10^{-4}$ | G4 |
| Example 58 | (69) | C | (9) | Stearic acid | Zinc | 0.0077 | $8.71 \times 10^{-4}$ | G4 |
| Example 59 | (70) | C | (10) | Stearic acid | Zinc | 0.0083 | $9.39 \times 10^{-4}$ | G3 |
| Example 60 | (71) | C | (11) | Stearic acid | Zinc | 0.0098 | $1.11 \times 10^{-3}$ | G2 |
| Comparative Example 12 | (72) | C | (12) | Stearic acid | Zinc | 0.0108 | $1.22 \times 10^{-3}$ | G1 |

TABLE 12

| | Toner (developer) | Colorant | Particles of metallic salt of fatty acid No. | Fatty acid | Metal | Iron content (% by mass) | Ratio of iron to other metals (molar ration) | Amount of particles of metallic salt of fatty acid added (parts) | Streaks |
|---|---|---|---|---|---|---|---|---|---|
| Example 61 | (73) | K | (7) | Stearic acid | Zinc | 0.0057 | $6.44 \times 10^{-4}$ | 0.008 | G3 |
| Example 62 | (74) | K | (7) | Stearic acid | Zinc | 0.0057 | $6.44 \times 10^{-4}$ | 0.01 | G4 |
| Example 63 | (75) | K | (7) | Stearic acid | Zinc | 0.0057 | $6.44 \times 10^{-4}$ | 0.02 | G5 |
| Example 64 | (76) | K | (7) | Stearic acid | Zinc | 0.0057 | $6.44 \times 10^{-4}$ | 0.23 | G5 |
| Example 65 | (77) | K | (7) | Stearic acid | Zinc | 0.0057 | $6.44 \times 10^{-4}$ | 0.26 | G4 |
| Example 66 | (78) | K | (7) | Stearic acid | Zinc | 0.0057 | $6.44 \times 10^{-4}$ | 0.48 | G4 |
| Example 67 | (79) | K | (7) | Stearic acid | Zinc | 0.0057 | $6.44 \times 10^{-4}$ | 0.52 | G3 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

toner particles; and particles of a metallic salt of a fatty acid deposited on the toner particles, the particles of the metallic salt of the fatty acid containing 0.0008% to 0.01% by mass of iron.

2. The electrostatic-image developing toner according to claim 1, wherein the particles of the metallic salt of the fatty acid comprise at least one metallic salt of a fatty acid selected from the group consisting of zinc salts of fatty acids, calcium salts of fatty acids, and magnesium salts of fatty acids.

3. The electrostatic-image developing toner according to claim 1, wherein the particles of the metallic salt of the fatty acid comprise at least one metallic salt of a fatty acid selected from the group consisting of metallic salts of stearic acid and metallic salts of lauric acid.

4. The electrostatic-image developing toner according to claim 1, wherein the molar ratio of iron atoms to metallic atoms other than iron atoms present in the particles of the metallic salt of the fatty acid (number of moles of iron atoms/number of moles of metallic atoms other than iron atoms) is $1\times10^{-4}$ to $1\times10^{-3}$.

5. The electrostatic-image developing toner according to claim 1, wherein the particles of the metallic salt of the fatty acid are present in an amount of 0.005 to 1 part by mass per 100 parts by mass of the toner particles.

6. The electrostatic-image developing toner according to claim 1, wherein the particles of the metallic salt of the fatty acid have a volume average particle size of 0.1 to 10 μm.

7. The electrostatic-image developing toner according to claim 1, wherein the toner particles comprise a polyester resin.

8. The electrostatic-image developing toner according to claim 7, wherein the polyester resin has a glass transition temperature (Tg) of 50° C. to 80° C.

9. The electrostatic-image developing toner according to claim 7, wherein the polyester resin has a weight average molecular weight (Mw) of 5,000 to 1,000,000.

10. The electrostatic-image developing toner according to claim 7, wherein the polyester resin has a molecular weight distribution Mw/Mn of 1.5 to 100.

11. The electrostatic-image developing toner according to claim 7, wherein the polyester resin is present in an amount of 40% to 95% of the total mass of the toner particles.

12. The electrostatic-image developing toner according to claim 1, wherein the toner particles contain a colorant in an amount of 1% to 30% of the total mass of the toner particles.

13. The electrostatic-image developing toner according to claim 1, wherein the toner particles contain a release agent in an amount of 1% to 20% of the total mass of the toner particles.

14. The electrostatic-image developing toner according to claim 13, wherein the release agent has a melting temperature of 50° C. to 110° C.

15. The electrostatic-image developing toner according to claim 1, wherein the toner particles have a volume average particle size (D50v) of 2 to 10 μm.

16. The electrostatic-image developing toner according to claim 1, wherein the toner particles have a shape factor SF1 of 110 to 150.

17. The electrostatic-image developing toner according to claim 1, further comprising inorganic particles deposited on the toner particles, the inorganic particles having a surface subjected to hydrophobic treatment.

18. The electrostatic-image developing toner according to claim 17, wherein the inorganic particles are present in an amount of 0.01% to 5% by mass of the toner particles.

19. An electrostatic image developer comprising the electrostatic-image developing toner according to claim 1.

20. A toner cartridge attachable to and detachable from an image-forming apparatus, the toner cartridge containing the electrostatic-image developing toner according to claim 1.

* * * * *